US008941551B2

(12) United States Patent
Mastoropoulos

(10) Patent No.: US 8,941,551 B2
(45) Date of Patent: Jan. 27, 2015

(54) GROUND CONNECTING SYSTEM FOR PLANE AND HELICAL MICROWAVE ANTENNA STRUCTURES

(76) Inventor: Vasilios Mastoropoulos, Salonika (GR)

( * ) Notice: Subject to any disclaimer, the term of this patent is extended or adjusted under 35 U.S.C. 154(b) by 298 days.

(21) Appl. No.: 13/506,372

(22) Filed: Apr. 16, 2012

(65) Prior Publication Data

US 2013/0271338 A1 Oct. 17, 2013

(51) Int. Cl.
*H01Q 1/48* (2006.01)

(52) U.S. Cl.
USPC ..... 343/848; 343/895; 343/893; 343/702; 343/700 MS

(58) Field of Classification Search
USPC ..... 343/700 MS, 848, 895, 893, 702
See application file for complete search history.

(56) References Cited

U.S. PATENT DOCUMENTS 4,183,027 A * 1/1980 Ehrenspeck ..... 343/726
2010/0164821 A1* 7/2010 Huang ..... 343/767

* cited by examiner

*Primary Examiner* — Dameon E Levi
*Assistant Examiner* — Hai Tran

(57) ABSTRACT

Ground connecting system for microwave plane or helical antenna structures comprising a radiating body that is connected to a power supply source located at ground level. In a plane antenna structure the radiating body is a flat plate with a plurality of ground connecting iron strips applied within appropriate recesses at selected regions thereof, whilst in a helical antenna structure the radiating body comprises a plurality of dielectric cylinders arranged along the circumference and inwardly the radiating surface, each dielectric cylinder located at the top of a coaxial power supply cable and being helicoidally wound with a conducting wire with ground connecting iron strips at the upper and bottom ends thereof. This selective grounding system results in a magnetic field being applied in between grounded and non-grounded regions that provides improved antenna transmission performance and effective isolation of the radiating body from the power supply source.

4 Claims, 5 Drawing Sheets

GROUND CONNECTING SYSTEM FOR PLANE AND HELICAL MICROWAVE ANTENNA STRUCTURES

THE FIELD OF THE ART

The invention relates to microwave antennas being employed in telecommunication stations, such as those of mobile telephony and discloses appropriate ground connecting arrangements for plane and helical antenna structures that provide enhanced performance characteristics and reduced operation and maintenance costs.

BACKGROUND OF THE INVENTION

Various designs of telecommunication antennas are known and, among these designs, plane and helical antenna structures are broadly employed. A typical plane antenna structure comprises a plate located above the ground that is being supplied from a power source located at ground level, whilst a typical helical antenna structure comprises a dielectric cylinder with a flexible printed wiring sheet wound around the perimeter thereof, such arrangement also connected to an appropriate power source located at ground level. These microwave antenna structures of the prior art present lack of efficiently isolating the antenna radiating body from the power source supplying the electric current that is required for operation thereof. As a result, part of the energy supplied to the antenna by the power supply source returns back to the power supply source and this leads to reduction of the effective power supply to the antenna and to malfunction of the power supply source that often necessitates repair or replacement thereof. Hence, the performance of the antenna is diminished, whilst operation and maintenance costs are enhanced.

The object of the present invention is to provide appropriate ground connecting systems that will efficiently ground the radiating body of the antenna so as to isolate the antenna from its power supply source, eliminate reverse energy flow from the antenna to the power source and thereby enhance the performance of the antenna, adequately protect the power supply source and reduce operation and maintenance costs.

SUMMARY OF THE INVENTION

The ground connecting system of the invention comprises ground connecting means, i.e. typical strips of iron metallic material, cut at appropriate sizes and mounted at appropriate locations so as to provide an effect of efficient isolation of the antenna from the power supply source associated therewith.

In accordance to a first preferred embodiment of the invention, the ground connecting system comprises iron strips being arranged within a single or a pair of opposing semicircular recesses provided onto the radiating surface of a typical plane antenna structure and in accordance to a second preferred embodiment of the invention the ground connecting system of the invention comprises iron strips being appropriately connected at the ends of selected copper strips being wound around a plurality of dielectric cylinders located at the top of a coaxial cable that is employed to feed energy in an arrangement of a multi-helical antenna structure.

BRIEF DESCRIPTION OF THE DRAWINGS

The invention will be made apparent to those skilled in the art by reference to the accompanying drawings depicting illustrative embodiments of the invention.

DETAILED DESCRIPTION OF PREFERRED EMBODIMENTS

Illustrative preferred embodiments of the invention will be presented hereinafter, in which the ground connecting system of the invention is being applied at selected regions of the radiating body of a microwave antenna structure with a scope of affording effective isolation of the radiating body from the power supply source, thereby enhancing antenna performance and diminishing operational and maintenance costs.

Figure 1:
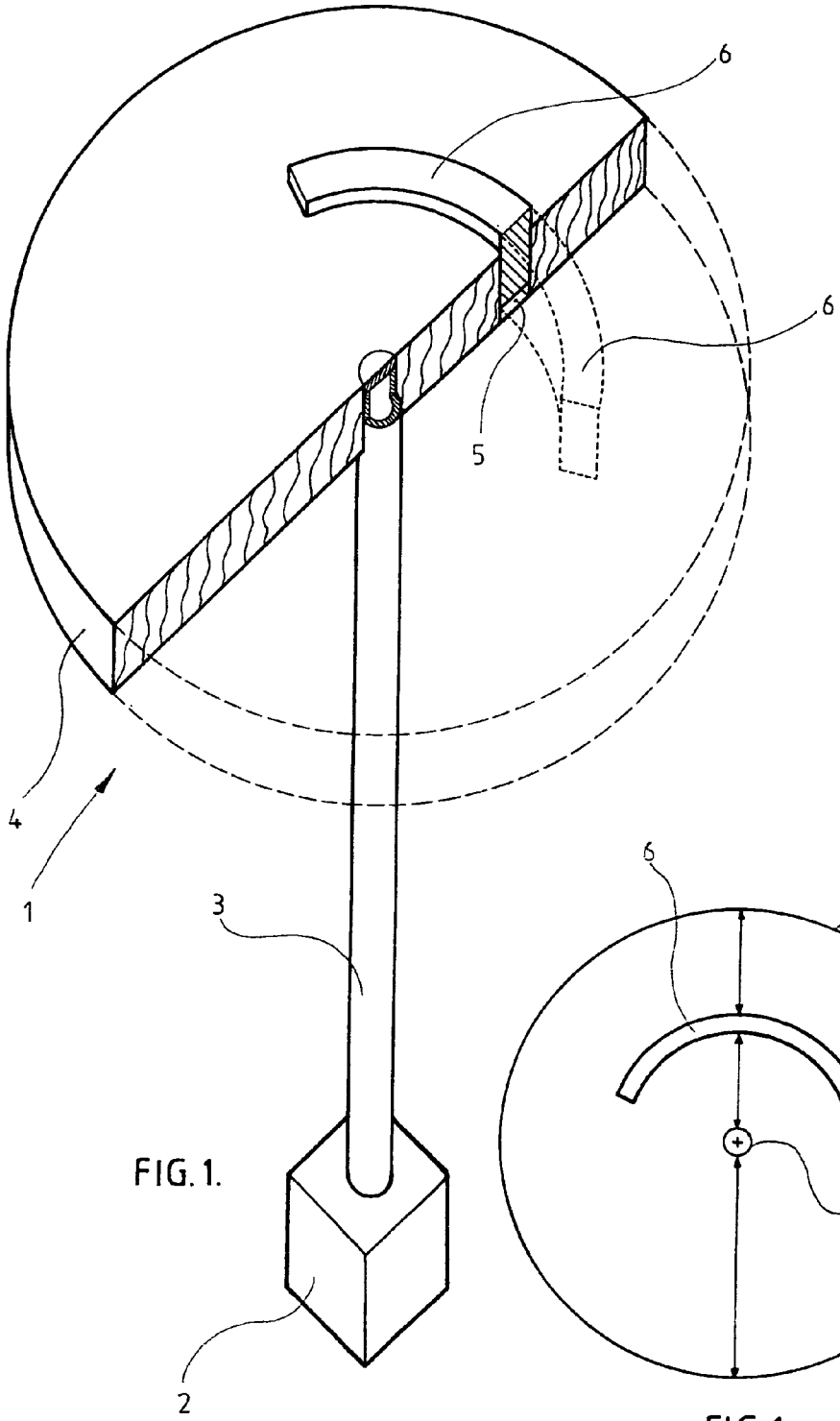
FIG. 1 shows a perspective view of a plane antenna structure incorporating a plate with a recess adapted to receive a ground connecting strip of the invention.
Figure 1A:
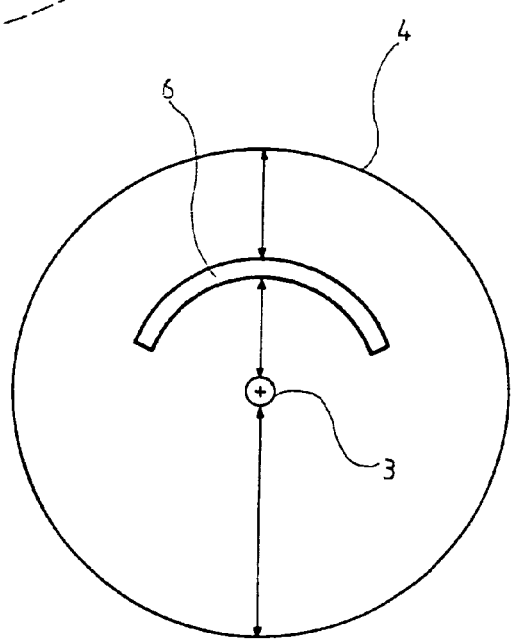
FIG. 1*a* shows a plan view of the plane antenna plate of FIG. 1.

In a first preferred embodiment of the invention, as depicted in FIG. 1, a plane antenna structure 1 comprises a radiating body with a plate 4 of a circular section that is centrally connected at a tubular pillar member through which passes the conductor 3 that feeds the antenna with the power required for operation thereof, such power being supplied by the power supply source 2. Plate 4 is provided with a recess 5 of semicircular configuration located intermediately between the center and the outer circumference of plate 4. A ground connecting strip 6 having a length equivalent to the length of the recess 5 is fixedly mounted within the recess 5, the strip having a width such as to project upwardly of the surface of plate 4.

Figure 2:
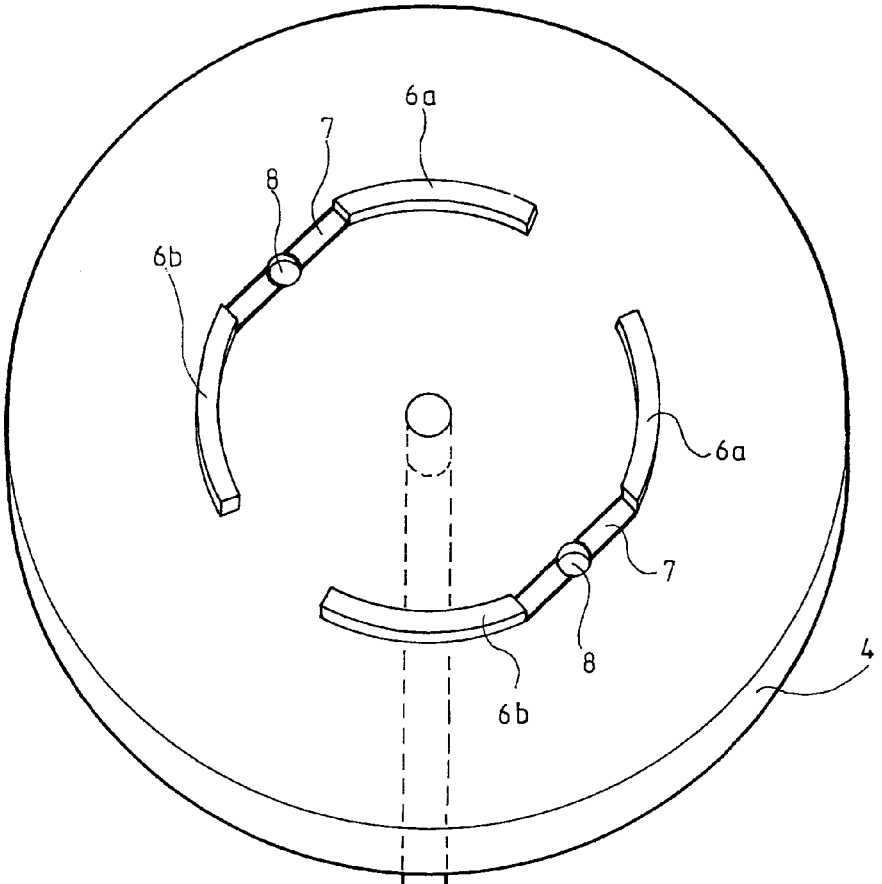
FIG. 2 shows a perspective view of a plane antenna structure with a plate incorporating a pair of opposing semicircular recesses adapted to receive ground connecting strips of the invention.
Figure 2A:
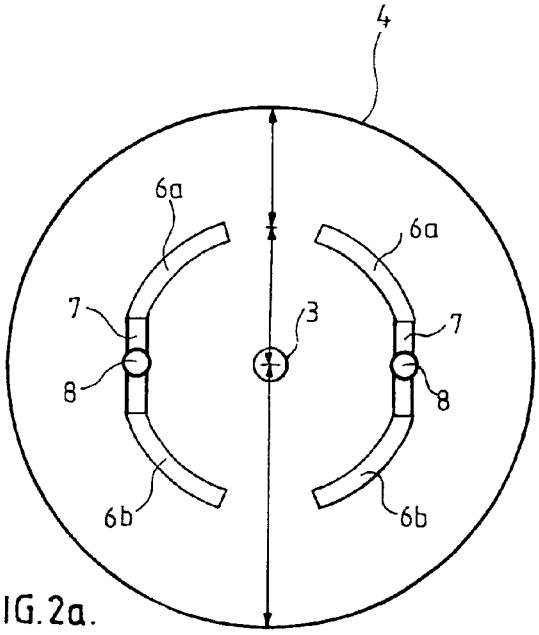
FIG. 2*a* shows a plan view of the plane antenna plate of FIG. 2.

In another embodiment of the plane antenna structure 1 of the invention, as depicted in FIG. 2, plate 4 incorporates a pair of opposing ground connecting arrangements, each arrangement comprising a pair of recesses each having a configuration of an arc of circle adapted to receive ground connecting strips of equivalent length. As shown in FIG. 2, strips 6*a* and 6*b* are mounted at the two ends of each one of the semicircular recesses, such strips 6*a* and 6*b* extending to and being connected by means of transmission conductive strips 7 with a recess 8 intermediately thereof. The eventual form of the grounding system on the surface of plate 4 of the plane antenna is a pair of opposing semicircular ground connecting strip arrangements.

Figure 3:
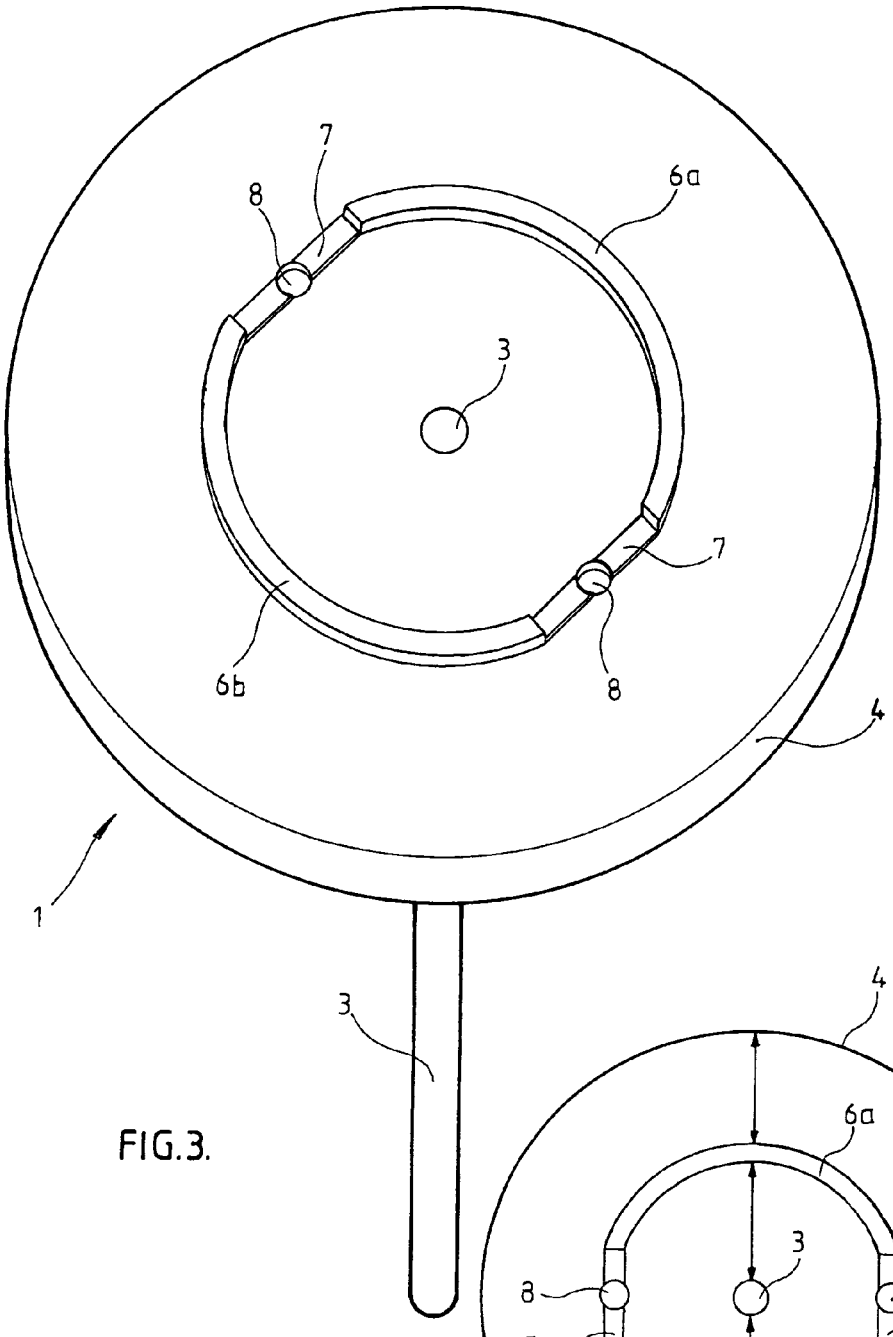
FIG. 3 shows a perspective view of a plane antenna structure with a plate incorporating a circular array of a pair of opposing semicircular recesses adapted to receive ground connecting strips of the invention, wherein the strips are joined by means of signal emitting conductive elements.
Figure 3A:
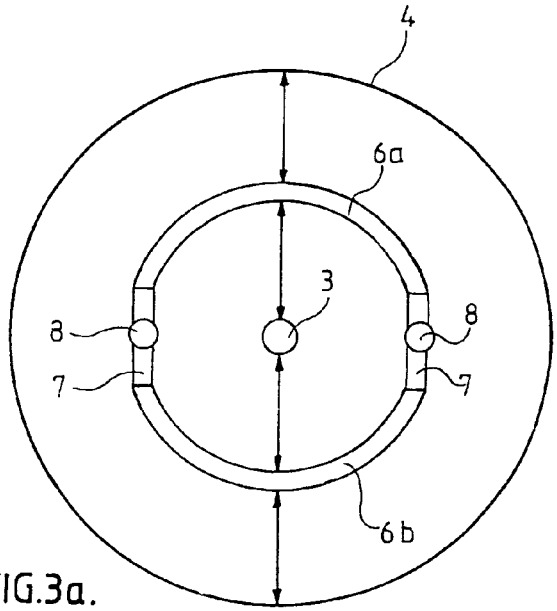
FIG. 3*a* shows a plan view of the plane antenna plate of FIG. 3.

In the plane antenna depicted in FIG. 3, the ground connecting means take the form of continuous semicircular ground connecting strips 6*a* and 6*b*, also extending to and being connected by means of transmission conductive strips 7 with a recess 8 intermediately thereof, thereby forming a closed loop of approximately circular configuration.

The transmission conductive strips 7 are adapted to operate as signal transmission lines for the plane antenna structure proposed in this invention and the recesses 8 intermediately thereof are adapted to activate transmission of signals in a direction perpendicular and upwardly of the plate 4.

In an illustrative application, plate 4 is made with a thickness of the order of 7-8 cm and recesses 5 have a depth of around 5-6 cm. The ground connecting strips 6 and 6*a*, 6*b* have a typical width of the order of the thickness of plate 4, i.e. a width of the order of 7-8 cm. Thus, when ground conductor strips 6 or 6*a*, 6*b* are mounted within corresponding recesses 5 on the surface of plate 4, they are expected to project upwardly at a height of the order of 1-3 cm.

In conventional plane antennas the power supply unit sends a signal to be transmitted to a transmitter that appropriately modulates it so as to enable transmission within a predetermined bandwidth. Subsequently the signal is received at the plate of the antenna that is conventionally configured in a convex form so as to be capable of forming a signal transmission beam that best directs transmission once the signal has been received by the transmitter. These conventional antenna structures however suffer from excessive losses due to overheating of the transmitter and to dispersion of energy in the course from the transmitter to the plate. Moreover the transmitter adds noise to the signal being transmitted and its directivity is inadequate.

The abovementioned plane antenna structure of the prior art is advantageously replaced by the plane antenna structure of the present invention wherein the previously convex antenna plate is replaced by the flat plate 4 incorporating the ground connecting strip 6 (FIG. 1) or strips 6*a*, 6*b* extending to transmission conductive strips 7 and forming either a pair of opposing semicircular strips (FIG. 2) or a closed loop (FIG. 3).

When electric current is being supplied through the conductor 3 at the center of plate 4, the ground connecting strip 6 (FIG. 1) or equivalently ground connecting strips 6*a* and 6*b* (FIG. 2 or FIG. 3) are being magnetized. Thus a positive pole is created at the circumference of plate 4 and a negative pole at the ground connecting strips. The current being supplied at plate 4 through conductor 3 and received at the non grounded area of the plate is directly radiated, whilst the current being received at the area of plate 4 equipped with the ground connecting arrangement of the invention is reflected to the adjacent non-grounded area and subsequently radiated. The creation of the abovementioned magnetic field in between the circumference of the plate and the area grounded by means of the ground connecting strips 6, 6*a*, 6*b* located intermediately between the centre and the circumference of the plate prevents flow of current back to the power supply source and enables an optimum performance of the plane antenna of the invention that achieves improved directivity and transmission of signals.

The ground connecting strips of the invention can also be advantageously applied in multi-helical microwave antenna structures.

A helical antenna is an antenna consisting of a conducting wire, e.g. copper, wound around a dielectric member in the form of a helix, usually in a linear "spiroidal" pattern (constant parallel spaced turns) providing consistent uniform radiation. In most cases, helical antennas are mounted over a ground plane. The feed line is connected between the bottom of the helix and the ground plane.

Figure 4:
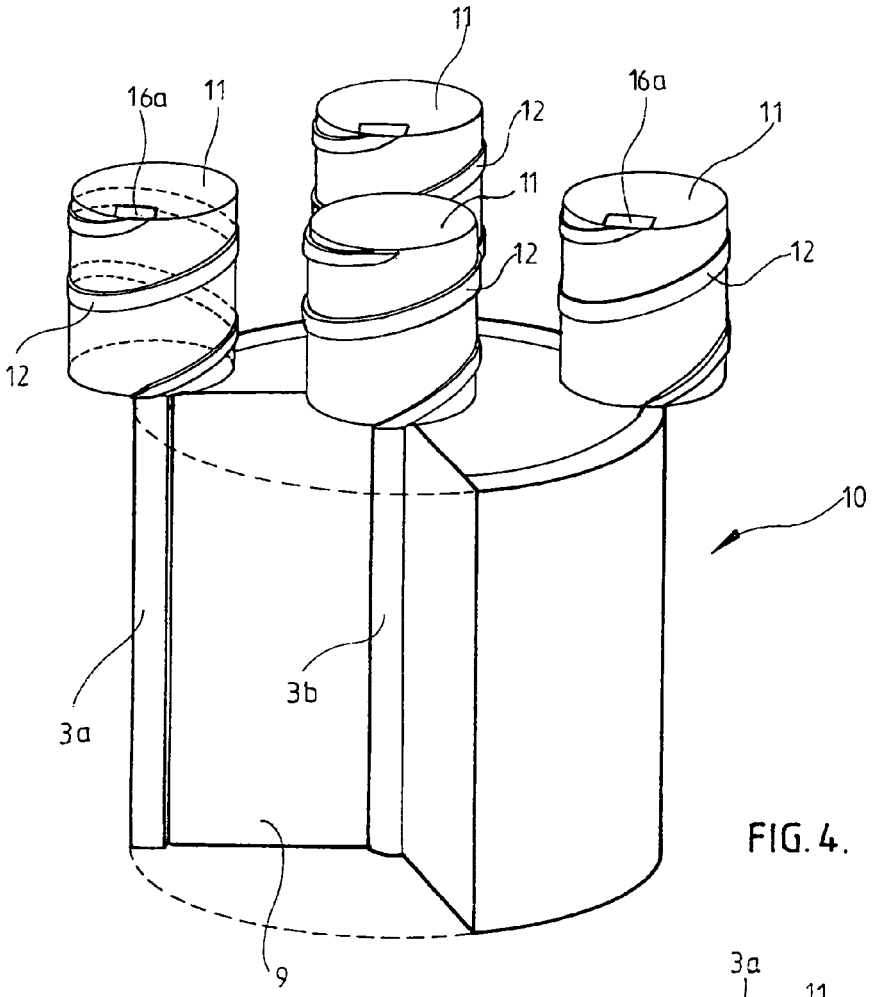
FIG. 4 shows a perspective view of a multi-helical antenna structure incorporating a plurality of dielectric cylinders with copper strip members helicoidally wound around each one of them, located at the upper end of a coaxial cable, wherein ground connecting strips of the invention are employed to effectively ground the two ends of selected copper strips wound around selected dielectric cylinders.
Figure 4B:
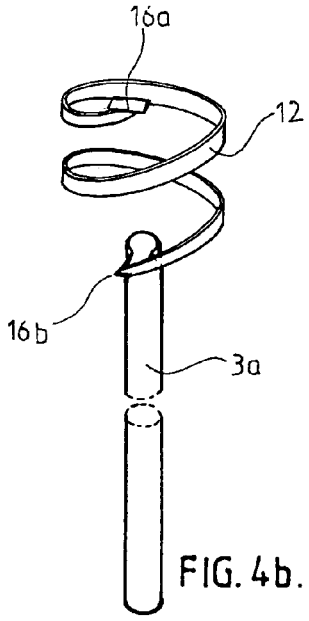
FIG. 4*b* shows a detail of the connection of the ground connecting strip of the invention at the upper end of a selected copper strip in a peripheral dielectric cylinder and at the bottom end of the same being connected to the peripheral coaxial cable.
Figure 4A:
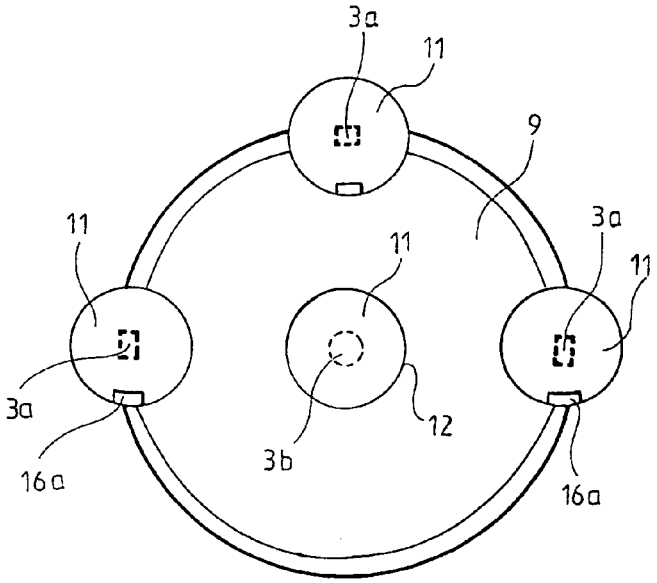
FIG. 4*a* shows a plan view of the multi-helical antenna structure of FIG. 4.

An illustrative preferred embodiment of such a multi-helical microwave antenna structure 10 as shown in FIGS. 4-4*a* comprises a plurality of four dielectric cylinders 11 located at the top of a coaxial power supply cable that comprises a centrally located power supply conductor 3*b* and peripheral power supply conductors 3*a*, each one of the four dielectric cylinders 11 being helicoidally wound with a conducting wire 12 that extends from an upper end at the top of the dielectric cylinder 11 to a bottom end at the bottom of the latter, such bottom end being appropriately connected to the power supply conductor 3*a* or 3*b*, In this embodiment of a multi-helical antenna structure, one dielectric cylinder 11 is located at the centre of the antenna assembly and supplied with power through connection to the centrally located power supply conductor 3*b*, whilst the remaining three dielectric cylinders 11 are located at equidistantly spaced distances along the circumference of the multi-helical antenna structure of FIG. 4-4*a* and supplied with power through connection to the corresponding peripherally located power supply conductors 3*a*, In this case the ground connecting system of the invention comprises ground connecting iron strips 16*a* and 16*b* being appropriately connected respectively at the upper and bottom ends of the conducting wires 12 of the peripheral dielectric cylinders 11 only with no ground connecting strips being applied at the centrally located dielectric cylinder 11 and the conducting wire 12 thereof.

Figure 5:
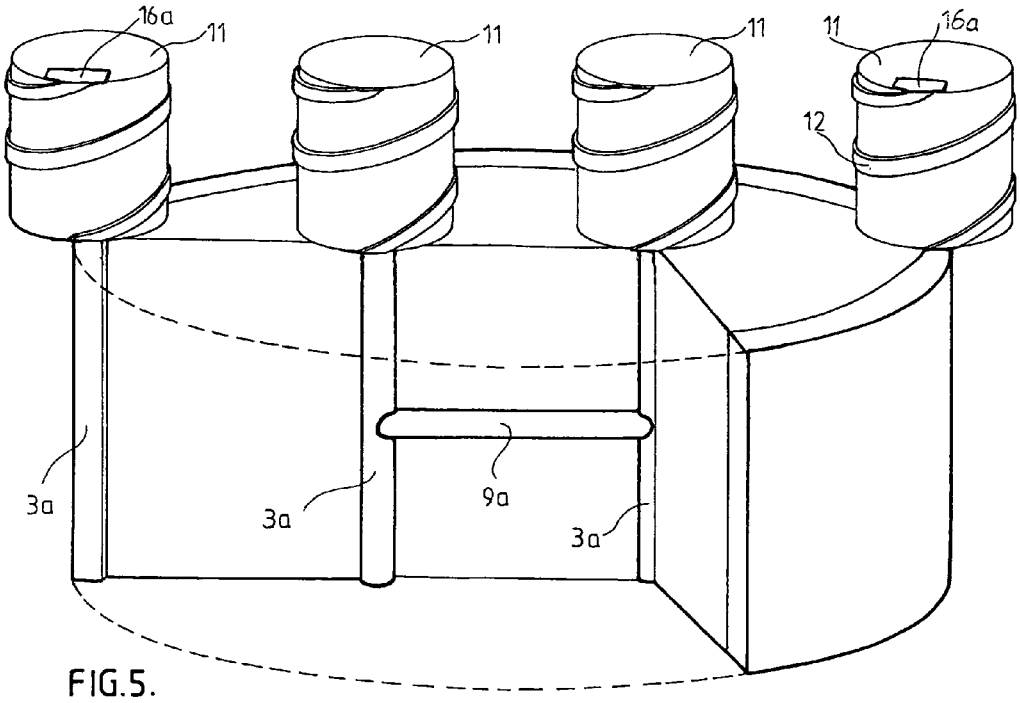
FIG. 5 shows a perspective view of an alternative embodiment of the multi-helical antenna structure incorporating a plurality of dielectric cylinders located at the upper end of a coaxial cable, wherein ground connecting strips of the invention are wound around each one of the dielectric cylinders.
Figure 5A:
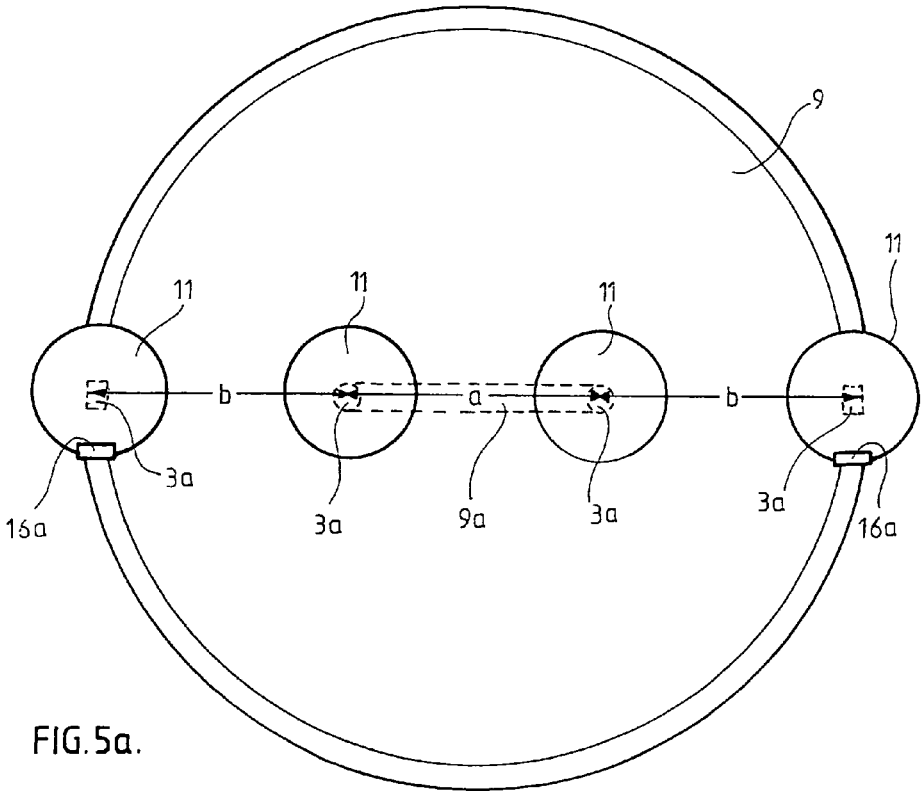
FIG. 5*a* shows a plan view of the multi-helical antenna structure of FIG. 5.

Another illustrative preferred embodiment of such a multi-helical microwave antenna structure 10 as shown in FIGS. 5-5*a* comprises a plurality of four dielectric cylinders 11 located at the top of a coaxial power supply cable and arranged in series along a diameter of the coaxial power supply cable, so that two of these dielectric cylinders 11 are located at diametrically opposite ends of the coaxial power supply cable and two of these dielectric cylinders 11 are located intermediately between the dielectric cylinders located at the circumference of the coaxial power supply cable and along the same diameter with the latter. Each one of the four dielectric cylinders 11 is helicoidally wound with a conducting wire 12 that extends from an upper end at the top of the dielectric cylinder 11 to a bottom end at the bottom of the latter, such bottom end being appropriately connected to a power supply conductor of an equivalent number of four power supply conductors 3*a* appropriately arranged within a mass of dielectric material 9. In this embodiment of a multi-helical antenna structure, the ground connecting system of the invention comprises ground connecting iron strips 16*a* and 16*b* being appropriately connected respectively at the upper and bottom ends of the conducting wires 12 of the peripheral dielectric cylinders 11 only with no ground connecting strips being applied at either one of the intermediately located dielectric cylinders 11 and the conducting wires 12 thereof.

The application of the grounding system of the invention is being effected merely at the ends of the helicoidally wound conducting wires 12 of the dielectric cylinders 11 located at the circumference of the coaxial power supply cable and not at the ends of the helicoidally wound conducting wires 12 of the dielectric cylinder 11 located at the center of the coaxial power supply cable as is the case with the embodiment shown in FIG. 4-4*a* or not at the ends of each one of the pair of dielectric cylinders 11 located serially in between the two peripheral dielectric cylinders 11 of the coaxial power supply cable as is the case with the embodiment shown in FIG. 5-5*a*, This differentiated grounding of the peripheral conducting wires 12 of the dielectric cylinders 11 and non-grounding of the conducting wires 12 of the dielectric cylinders 11 located centrally or inwardly in the coaxial power supply cable results in the creation of a negative pole at the perimeter of the coaxial power supply cable and a positive pole at the center thereof.

The current being supplied through the coaxial power supply cable and received at the non grounded inner conducting wires 12 is thus directly radiated, whilst the current being received at the grounded outer conducting wires 12 located at the circumference of the coaxial power supply cable is reflected to the adjacent inner non-grounded area and subsequently radiated. The creation of the abovementioned magnetic field in between the circumference of the plate grounded by means of the ground connecting strips 16*a* and 16*b* at the ends of each one of the thereby grounded conducting wires 12 of the peripheral dielectric cylinders 11 and the non-grounded inner area wherein the conducting wires 12 of the inner dielectric cylinders 11 are not grounded adequately prevents flow of current back to the power supply source and enables an optimum performance of the multi-helical antenna of the invention that achieves improved directivity and transmission of signals.

The invention claimed is:

1. Ground connecting system for microwave antenna structures comprising a radiating body that is centrally connected at a tubular pillar member, a conductor (3, 3*b*) passing through said tubular pillar member to feed the antenna with the power required for operation thereof, the power being supplied by a power supply source (2) located at ground level, a plurality of iron strips (6, 6*a*, 6*b*, 16*a*, 16*b*) being applied at selected regions of the radiating body of the microwave antenna structure with a scope of creating selected grounded regions and setting up a magnetic field onto the radiating surface of said radiating body of the antenna structure in between said selected grounded regions and non-grounded regions of the radiating surface, such as to result in the current being supplied through the conductor (3, 3*b*) and received at a non-grounded region to be directly radiated and in the current being received at said selected grounded regions to be reflected towards the adjacent non-grounded area and subsequently radiated, thereby affording effective isolation of the radiating body from the power supply source, wherein in a microwave helical antenna structure (10) said radiating comprising a plurality of dielectric cylinders (11) arranged along the circumference and inwardly the radiating surface, each dielectric cylinder (11) located at the top of a coaxial power supply cable comprising a centrally located power supply conductor (3*b*) for a dielectric cylinder (11) located at the center of the radiating body and peripheral power supply conductors (3*a*) for the dielectric cylinders (11) located around the center and along the circumference of the radiating body, each of the dielectric cylinders (11) being helicoidally wound with a conducting wire (12) extending from an upper end at the top of the dielectric cylinder (11) to a bottom end at the bottom thereof, said bottom end being connected to said power supply conductor (3*a*) or (3*b*), ground connecting iron strips (16*a*) and (16*b*) being connected respectively at the upper and bottom ends of the conducting wires (12) of the dielectric cylinders (11) arranged along the circumference of the radiating body only, whilst no ground connecting strips being applied at the conducting wires (12) of the dielectric cylinder (11) located inwardly, whereby a grounded region is created along the circumference of the radiating body of said microwave helical antenna structure (10).

2. Ground connecting system for microwave antenna structures as claimed in claim 1, wherein in a microwave plane antenna structure (1), said radiating body comprising a flat plate (4) of circular section, said flat plate (4) centrally connected at said tubular pillar member incorporating a conductor (3) supplying power from said power supply source (2), said plate (4) being provided with at least one recess (5) of semicircular configuration located intermediately between the center and the outer circumference thereof, a ground connecting strip (6) having a length equivalent to the length of said recess (5) being fixedly mounted within the recess (5), said ground connecting strip (6) having a width such as to project upwardly of the surface of plate (4), whereby a grounded region is created at the vicinity of said ground connecting strip (6).

3. Ground connecting system for microwave antenna structures as claimed in claim 2, wherein in a microwave plane antenna structure (1), said plate (4) being provided with a pair of opposing ground connecting arrangements, each arrangement comprising a pair of semicircular recesses each having a configuration of an arc of circle adapted to receive ground connecting strips (6*a*, 6*b*) of equivalent length, said ground connecting strips (6*a*, 6*b*) being mounted at two ends of each one of the semicircular recesses and being connected by means of transmission conductive strips (7) with a recess (8) intermediately thereof, whereby a grounded region is created at the vicinity of said ground connecting strips (6*a*, 6*b*).

4. Ground connecting system for microwave antenna structures as claimed in claim 2, wherein in a microwave plane antenna structure (1), said plate (4) being provided with a pair of opposing ground connecting arrangements, each arrangement comprising a pair of semicircular recesses, a pair of semicircular ground connecting strips (6*a*, 6*b*) being mounted correspondingly within said pair of semicircular recesses, said pair of semicircular ground connecting strips (6*a*, 6*b*) being connected by means of transmission conductive strips (7) with a recess (8) intermediately thereof, whereby a closed loop of approximately circular configuration is being formed around the center of said plate (4), said closed loop constituting the grounded region onto the radiating surface of said microwave plane antenna structure (1).

* * * * *